US011769395B2

(12) United States Patent
Kazi et al.

(10) Patent No.: US 11,769,395 B2
(45) **Date of Patent: *Sep. 26, 2023**

(54) COMMUNITY-BASED SECURITY SYSTEM

(71) Applicant: Nortek Security & Control LLC, Carlsbad, CA (US)

(72) Inventors: Taufiqul Kazi, Carlsbad, CA (US); Laura Elizabeth Knight, San Diego, CA (US)

(73) Assignee: Nortek Security & Control LLC, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/863,282

(22) Filed: Jul. 12, 2022

(65) Prior Publication Data

US 2022/0351606 A1 Nov. 3, 2022

Related U.S. Application Data

(63) Continuation of application No. 17/038,913, filed on Sep. 30, 2020, now Pat. No. 11,468,763, which is a continuation of application No. 16/119,476, filed on Aug. 31, 2018, now Pat. No. 10,847,018.

(51) Int. Cl.
*G08B 27/00* (2006.01)
*G08B 26/00* (2006.01)

(52) U.S. Cl.
CPC ..... *G08B 27/003* (2013.01); *G08B 26/008* (2013.01)

(58) Field of Classification Search
CPC ..... G08B 27/003; G08B 26/008
See application file for complete search history.

(56) References Cited

U.S. PATENT DOCUMENTS

| | | | | |
|---|---|---|---|---|
| 7,180,415 | B2 | 2/2007 | Bankert et al. | |
| 7,825,796 | B1 | 11/2010 | Simon | |
| 9,449,491 | B2 | 9/2016 | Sager et al. | |
| 10,847,018 | B2 | 11/2020 | Kazi et al. | |
| 2007/0222578 | A1* | 9/2007 | Iwamura | G08B 27/003 340/538 |
| 2008/0238668 | A1 | 10/2008 | Johnsen | |
| 2012/0154126 | A1 | 6/2012 | Cohn et al. | |

(Continued)

FOREIGN PATENT DOCUMENTS

GB 2448196 A 10/2008

OTHER PUBLICATIONS

"U.S. Appl. No. 16/119,476, Final Office Action dated Jun. 10, 2020", 11 pgs.

(Continued)

*Primary Examiner* — Kam Wan Ma
(74) *Attorney, Agent, or Firm* — Schwegman Lundberg & Woessner, P.A.

(57) ABSTRACT

A server accesses a security system profile of a first security system. The security system profile identifies a plurality of sensors connected to the first security system. The server identifies a second security system based on at least a first sensor of the plurality of sensors coupled to the first security system. The server then generates a notification sharing profile for the first security system based on the security system profile. The notification sharing profile indicates that the second security system corresponds to the first sensor. A first event triggered by the first sensor causes a first notification to the second security system.

17 Claims, 17 Drawing Sheets

(56) References Cited

U.S. PATENT DOCUMENTS

| | | | | |
|---|---|---|---|---|
| 2013/0009749 | A1 | 1/2013 | Vijayaraghavan et al. | |
| 2017/0309157 | A1 | 10/2017 | Nandanavanam et al. | |
| 2017/0353487 | A1 | 12/2017 | Spies et al. | |
| 2018/0174413 | A1 | 6/2018 | Siminoff | |
| 2018/0232895 | A1* | 8/2018 | Modestine | G08B 3/10 |
| 2020/0074841 | A1 | 3/2020 | Kazi et al. | |
| 2021/0012646 | A1 | 1/2021 | Kazi et al. | |

OTHER PUBLICATIONS

"U.S. Appl. No. 16/119,476, Non Final Office Action dated Feb. 6, 2020", 8 pgs.
"U.S. Appl. No. 16/119,476, Notice of Allowance dated Jul. 24, 2020", 8 pgs.
"U.S. Appl. No. 16/119,476, Response filed May 6, 2020 to Non Final Office Action dated Feb. 6, 2020", 11 pgs.
"U.S. Appl. No. 16/119,476, Response filed Jun. 29, 2020 to Final Office Action dated Jun. 10, 2020", 14 pgs.
"U.S. Appl. No. 17/038,913, Notice of Allowance dated Jun. 7, 2022", 9 pgs.

* cited by examiner

1100

| SENSOR ID 1102 | SENSOR TYPE 1106 | SENSOR STATUS 1104 | SENSOR NOTIFICATION VECTOR 1112 | SECURITY SYSTEM SOURCE 1108 | SECURITY SYSTEM TARGET 1110 |
|---|---|---|---|---|---|
| WS1 | WATER SENSOR | WATER DETECTED | ONE FLOOR BELOW | SECURITY SYSTEM 720 | SECURITY SYSTEM 708 |
| SM1 | SMOKE SENSOR | SMOKE DETECTED | ONE FLOOR ABOVE AND ADJACENT | SECURITY SYSTEM 708 | SECURITY SYSTEM 712, 720, 704 |
| GL1 | GLASS BREAK DETECTOR | BREAKING DETECTED | ADJACENT | SECURITY SYSTEM 720 | SECURITY SYSTEM 704, 712 |
| EN1 | DOOR SENSOR | OPEN | USER-SPECIFIED | SECURITY SYSTEM 720 | SECURITY SYSTEM 1012 |

FIG. 11

COMMUNITY-BASED SECURITY SYSTEM

CLAIM OF PRIORITY

This application is a continuation of U.S. patent application Ser. No. 17/038,913, filed Sep. 30, 2020, which is a continuation of U.S. patent application Ser. No. 16/119,476, filed Aug. 31, 2018, which are hereby incorporated by reference herein in their entirety.

BACKGROUND

A home security system can be used to notify a homeowner of intrusions and other alerts (e.g., porch light left on all night). However, these security systems are typically standalone units that operate independently from other security systems located nearby.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

FIG. 11 is a table illustrating an example of a sharing profile of a security system, in accordance with one example embodiment.

DETAILED DESCRIPTION

Glossary

Figure 1:
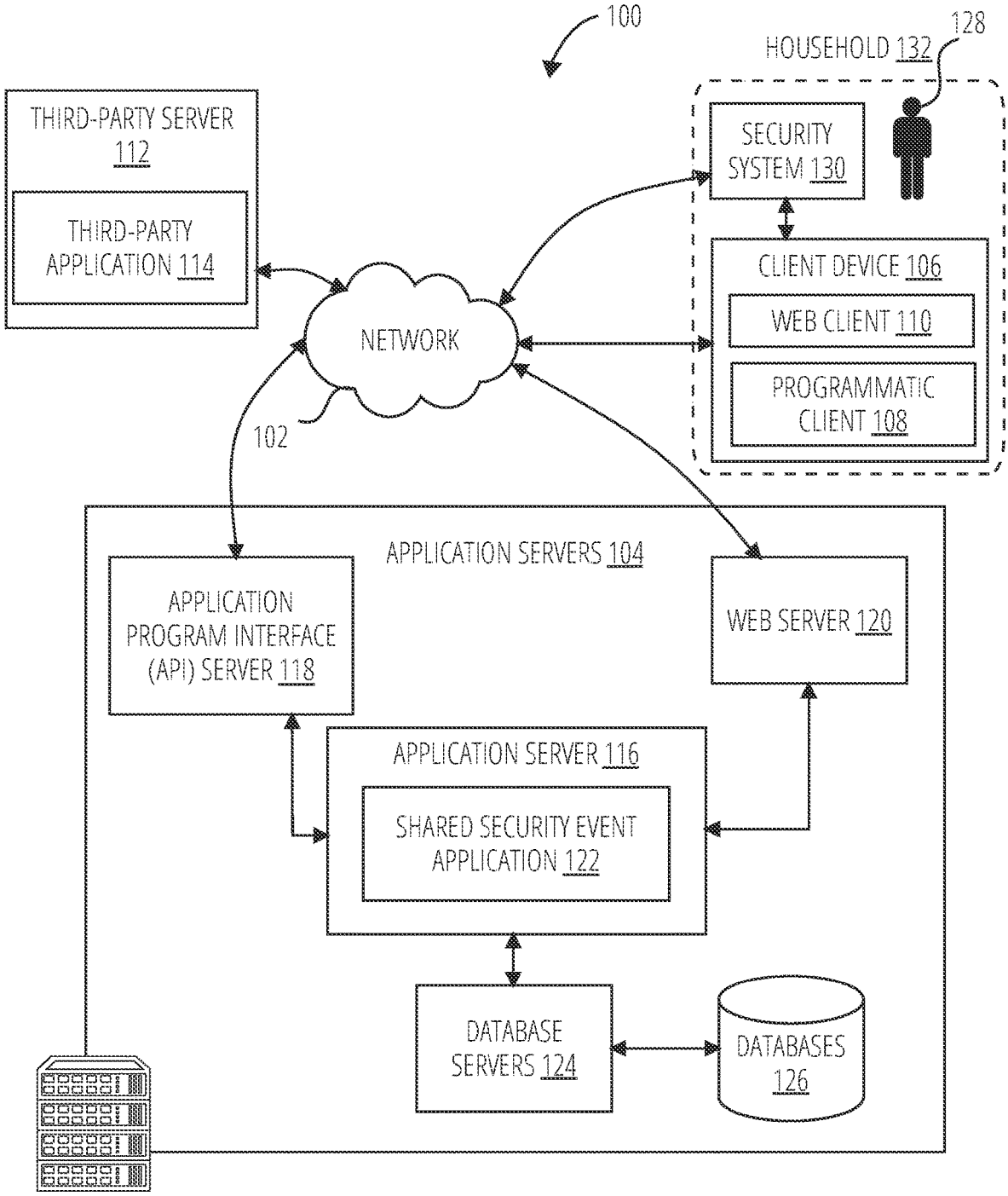
FIG. 1 is a diagrammatic representation of a networked environment in which the present disclosure may be deployed, in accordance with some example embodiments.

"Component" in this context refers to a device, physical entity, or logic having boundaries defined by function or subroutine calls, branch points, APIs, or other technologies that provide for the partitioning or modularization of particular processing or control functions. Components may be combined via their interfaces with other components to carry out a machine process. A component may be a packaged functional hardware unit designed for use with other components and a part of a program that usually performs a particular function of related functions. Components may constitute either software components (e.g., code embodied on a machine-readable medium) or hardware components. A "hardware component" is a tangible unit capable of performing certain operations and may be configured or arranged in a certain physical manner. In various example embodiments, one or more computer systems (e.g., a standalone computer system, a client computer system, or a server computer system) or one or more hardware components of a computer system (e.g., a processor or a group of processors) may be configured by software (e.g., an application or application portion) as a hardware component that operates to perform certain operations as described herein. A hardware component may also be implemented mechanically, electronically, or any suitable combination thereof. For example, a hardware component may include dedicated circuitry or logic that is permanently configured to perform certain operations. A hardware component may be a special-purpose processor, such as a field-programmable gate array (FPGA) or an application specific integrated circuit (ASIC). A hardware component may also include programmable logic or circuitry that is temporarily configured by software to perform certain operations. For example, a hardware component may include software executed by a general-purpose processor or other programmable processor. Once configured by such software, hardware components become specific machines (or specific components of a machine) uniquely tailored to perform the configured functions and are no longer general-purpose processors. It will be appreciated that the decision to implement a hardware component mechanically, in dedicated and permanently configured circuitry, or in temporarily configured circuitry (e.g., configured by software), may be driven by cost and time considerations. Accordingly, the phrase "hardware component"(or "hardware-implemented component") should be understood to encompass a tangible entity, be that an entity that is physically constructed, permanently configured (e.g., hardwired), or temporarily configured (e.g., programmed) to operate in a certain manner or to perform certain operations described herein. Considering embodiments in which hardware components are temporarily configured (e.g., programmed), each of the hardware components need not be configured or instantiated at any one instance in time. For example, where a hardware component comprises a general-purpose processor configured by software to become a special-purpose processor, the general-purpose processor may be configured as respectively different special-purpose processors (e.g., comprising different hardware components) at different times. Software accordingly configures a particular processor or processors, for example, to constitute a particular hardware component at one instance of time and to constitute a different hardware component at a different instance of time. Hardware components can provide information to, and receive information from, other hardware components. Accordingly, the described hardware components may be regarded as being communicatively coupled. Where multiple hardware components exist contemporaneously, communications may be achieved through signal transmission (e.g., over appropriate circuits and buses) between or among two or more of the hardware components. In embodiments in which multiple hardware components are configured or instantiated at different times, communications between such hardware components may be achieved, for example, through the storage and retrieval of information in memory structures to which the multiple hardware components have access. For example, one hardware component may perform an operation and store the output of that operation in a memory device to which it is communicatively coupled. A further hardware component may then, at a later time, access the memory device to retrieve and process the stored output. Hardware components may also initiate communications with input or output devices, and can operate on a resource (e.g., a collection of information). The various operations of example methods described herein may be performed, at least partially, by one or more processors that are temporarily configured (e.g., by software) or permanently configured to perform the relevant operations. Whether temporarily or permanently configured, such processors may constitute processor-implemented components that operate to perform one or more operations or functions described herein. As used herein, "processor-implemented component" refers to a hardware component implemented using one or more processors. Similarly, the methods described herein may be at least partially processor-implemented, with a particular processor or processors being an example of hardware. For example, at least some of the operations of a method may be performed by one or more processors or processor-implemented components. Moreover, the one or more processors may also operate to support performance of the relevant operations in a "cloud computing" environment or as a "software as a service" (SaaS). For example, at least some of the operations may be performed by a group of computers (as examples of machines including processors), with these operations being accessible via a network (e.g., the Internet) and via one or more appropriate interfaces (e.g., an API). The performance of certain of the operations may be distributed among the processors, not only residing within a single machine, but deployed across a number of machines. In some example embodiments, the processors or processor-implemented components may be located in a single geographic location (e.g., within a home environment, an office environment, or a server farm). In other example embodiments, the processors or processor-implemented components may be distributed across a number of geographic locations.

"Communication Network" in this context refers to one or more portions of a network that may be an ad hoc network, an intranet, an extranet, a virtual private network (VPN), a local area network (LAN), a wireless LAN (WLAN), a wide area network (WAN), a wireless WAN (WWAN), a metropolitan area network (MAN), the Internet, a portion of the Internet, a portion of the Public Switched Telephone Network (PSTN), a plain old telephone service (POTS) network, a cellular telephone network, a wireless network, a Wi-Fi® network, another type of network, or a combination of two or more such networks. For example, a network or a portion of a network may include a wireless or cellular network and the coupling may be a Code Division Multiple Access (CDMA) connection, a Global System for Mobile communications (GSM) connection, or other types of cellular or wireless coupling. In this example, the coupling may implement any of a variety of types of data transfer technology, such as Single Carrier Radio Transmission Technology (1xRTT), Evolution-Data Optimized (EVDO) technology, General Packet Radio Service (GPRS) technology, Enhanced Data rates for GSM Evolution (EDGE) technology, third Generation Partnership Project (3GPP) including 3G, fourth generation wireless (4G) networks, Universal Mobile Telecommunications System (UMTS), High Speed Packet Access (HSPA), Worldwide Interoperability for Microwave Access (WiMAX), Long Term Evolution (LTE) standard, others defined by various standard-setting organizations, other long-range protocols, or other data transfer technology.

"Machine-Storage Medium" in this context refers to a single or multiple storage devices and/or media (e.g., a centralized or distributed database, and/or associated caches and servers) that store executable instructions, routines, and/or data. The term shall accordingly be taken to include, but not be limited to, solid-state memories, and optical and magnetic media, including memory internal or external to processors. Specific examples of machine-storage media, computer-storage media and/or device-storage media include non-volatile memory, including by way of example semiconductor memory devices, e.g., erasable programmable read-only memory (EPROM), electrically erasable programmable read-only memory (EEPROM), FPGA, and flash memory devices; magnetic disks such as internal hard disks and removable disks; magneto-optical disks; and CD-ROM and DVD-ROM disks. The terms "machine-storage medium," "device-storage medium," "computer-storage medium" mean the same thing and may be used interchangeably in this disclosure. The terms "machine-storage media," "computer-storage media," and "device-storage media" specifically exclude carrier waves, modulated data signals, and other such media, at least some of which are covered under the term "signal medium."

"Processor" in this context refers to any circuit or virtual circuit (a physical circuit emulated by logic executing on an actual processor) that manipulates data values according to control signals (e.g., "commands," "op codes," "machine code," etc.) and which produces corresponding output signals that are applied to operate a machine. A processor may, for example, be a Central Processing Unit (CPU), a Reduced Instruction Set Computing (RISC) processor, a Complex Instruction Set Computing (CISC) processor, a Graphics Processing Unit (GPU), a Digital Signal Processor (DSP), an ASIC, a Radio-Frequency Integrated Circuit (RFIC) or any combination thereof. A processor may further be a multi-core processor having two or more independent processors (sometimes referred to as "cores") that may execute instructions contemporaneously.

"Carrier Signal" in this context refers to any intangible medium that is capable of storing, encoding, or carrying instructions for execution by the machine, and includes digital or analog communications signals or other intangible media to facilitate communication of such instructions.

Instructions may be transmitted or received over a network using a transmission medium via a network interface device.

"Signal Medium" in this context refers to any intangible medium that is capable of storing, encoding, or carrying the instructions for execution by a machine and includes digital or analog communications signals or other intangible media to facilitate communication of software or data. The term "signal medium" shall be taken to include any form of a modulated data signal, carrier wave, and so forth. The term "modulated data signal" means a signal that has one or more of its characteristics set or changed in such a matter as to encode information in the signal. The terms "transmission medium" and "signal medium" mean the same thing and may be used interchangeably in this disclosure.

"Computer-Readable Medium" in this context refers to both machine-storage media and transmission media. Thus, the terms include both storage devices/media and carrier waves/modulated data signals. The terms "machine-readable medium," "computer-readable medium" and "device-readable medium" mean the same thing and may be used interchangeably in this disclosure.

Description

Example methods and systems are directed to a notification sharing system for security devices. Examples merely typify possible variations. Unless explicitly stated otherwise, components and functions are optional and may be combined or subdivided, and operations may vary in sequence or be combined or subdivided. In the following description, for purposes of explanation, numerous specific details are set forth to provide a thorough understanding of example embodiments. It will be evident to one skilled in the art, however, that the present subject matter may be practiced without these specific details.

Traditional security systems monitor and alert a single entity (owner/user or a private security service). The present application describes forming a group of security systems (e.g., community-based security systems), connected via shared apps through the cloud, to alert and respond to events triggered by sensors connected to the security systems. Traditional security systems typically detect intrusion and provide notification to the homeowner via cloud-based applications operating on the homeowner's mobile device. However, there are situations where it would be desirable to notify third parties of specific events. For example, in an apartment complex, a renter may wish to know whether the person above him/her just had an overflow from the tub or washer. In a neighborhood, alerting a neighbor to an immediate intrusion event may bring a faster response than a police unit. In another example, a homeowner may be locked out of his/her house without a mobile device or a physical key. The homeowner may ask his/her neighbor to unlock his/her door on behalf of the homeowner. The present application describes a method for allowing specific controlled groups (e.g., a community) to share security/smart home information based on a type of sensor or event.

In another example, the security system determines whether a detected emergency (e.g., smoke alarm detects smoke) impacts neighbors in the nearby area of the security system. The security system can automatically push notifications to the other security systems. In another example, the security system provides the notification to a remote server that determines whether to share the notification and with which security system.

FIG. 1 is a diagrammatic representation of a network environment 100 in which some example embodiments of the present disclosure may be implemented or deployed.

One or more application servers 104 provide server-side functionality via a network 102 to a networked user device, in the form of a security system 130 and a client device 106 of the user 128. The security system 130 includes a control panel (not shown) connected to sensors in a household 132 of the user 128. A web client 110 (e.g., a browser) and a programmatic client 108 (e.g., an "app") are hosted and execute on the client device 106. The client device 106 can communicate with the security system 130 via the network 102 or via other wireless or wired means with security system 130.

An API server 118 and a web server 120 provide respective programmatic and web interfaces to application servers 104. A specific application server 116 hosts a shared security event application 122, which includes components, modules, and/or applications that are further described below with respect to FIG. 4. The shared security event application 122 generates a notification sharing profile for the security system 130 of the household 132. In one example, the shared security event application 122 receives an alert from a sensor of the security system 130 and identifies other security systems based on the type of sensor and the type of alert. The shared security event application 122 then generates a message to the other security systems based on the type of sensor and the type of alert.

The web client 110 communicates with the shared security event application 122 via the web interface supported by the web server 120. Similarly, the programmatic client 108 communicates with the shared security event application 122 via the programmatic interface provided by the API server 118. The third-party application 114 may, for example, be a topology application that determines the topology of a building, apartment complex, or neighborhood. The application server 116 is shown to be communicatively coupled to database servers 124 that facilitate access to an information storage repositories or databases 126. In an example embodiment, the databases 126 includes storage devices that store information to be published and/or processed by the shared security event application 122.

Additionally, a third-party application 114 executing on a third-party server 112, is shown as having programmatic access to the application server 116 via the programmatic interface provided by the API server 118. For example, the third-party application 114, using information retrieved from the application server 116, may support one or more features or functions on a website hosted by the third party. In one example, the third-party server 112 communicates with a remote-controlled device (e.g., smart door lock) located at the household 132. The third-party server 112 provides the door lock status to the security system 130, the client device 106, or the application server 116. In another example, the security system 130, the client device 106, and the application server 116 can control the door lock via the third-party application 114.

Figure 2:
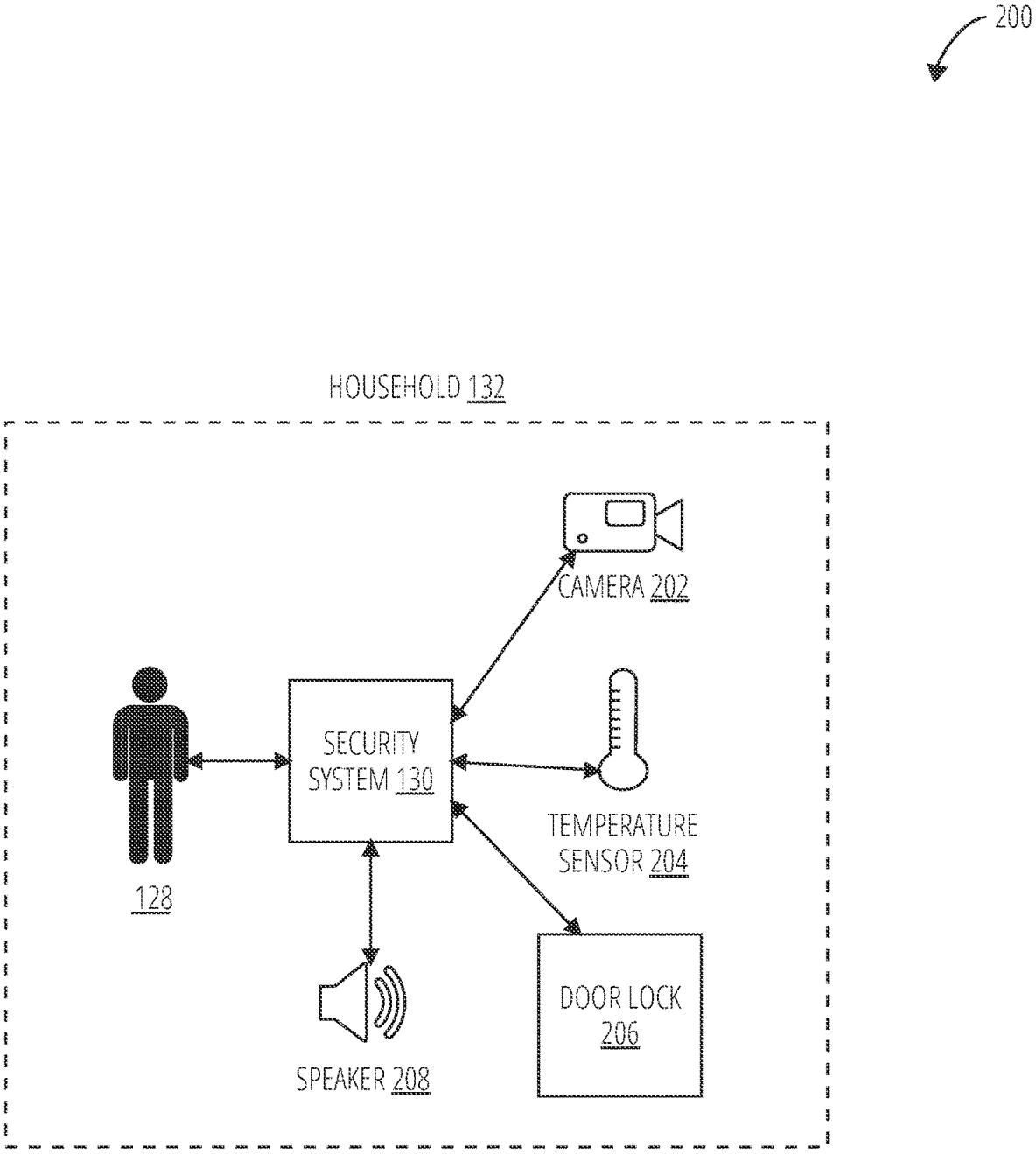
FIG. 2 is a block diagram illustrating an example of a security system in a household, in accordance with one example embodiment.

FIG. 2 is a block diagram 200 illustrating an example of a security system in a household, in accordance with one example embodiment. The household 132 includes, for example, the user 128 and the security system 130. The security system 130 is connected to security sensors and devices: a camera 202, a temperature sensor 204, a door lock 206, and a speaker 208. The household 132 may be, for example, an apartment of an apartment complex, a house, an office space, a room, or any other geographically boundary-defined space.

Figure 3:
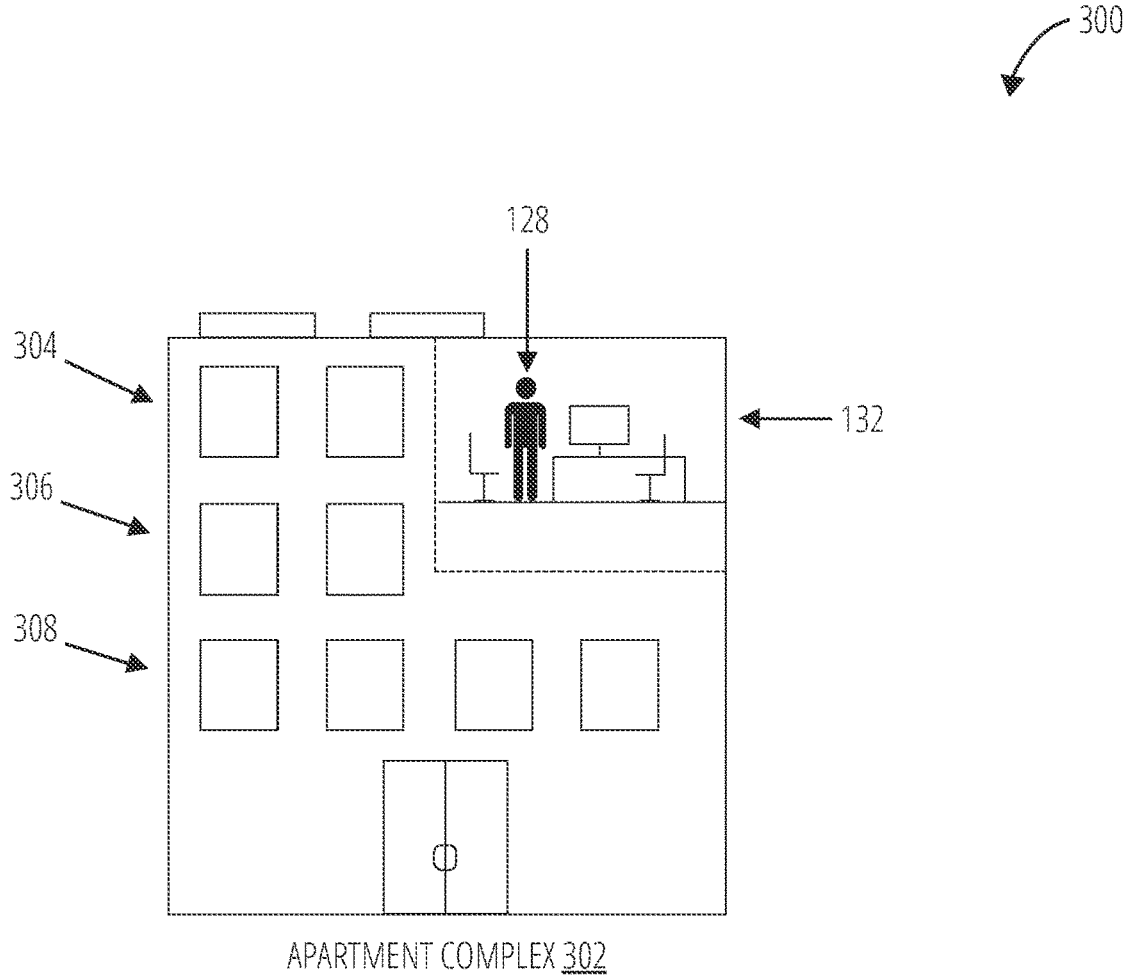
FIG. 3 is a block diagram illustrating nearby households with security systems, in accordance with one example embodiment.

FIG. 3 is a block diagram 300 illustrating nearby households with security systems, in accordance with one example embodiment. In one example, the user 128 of the household 132 is located in an apartment complex 302. The apartment complex 302 includes other households (in each apartment or unit), for example: household 304, household 306, household 308. In another example embodiment, the security systems may be implemented in households of a neighborhood.

Figure 4:
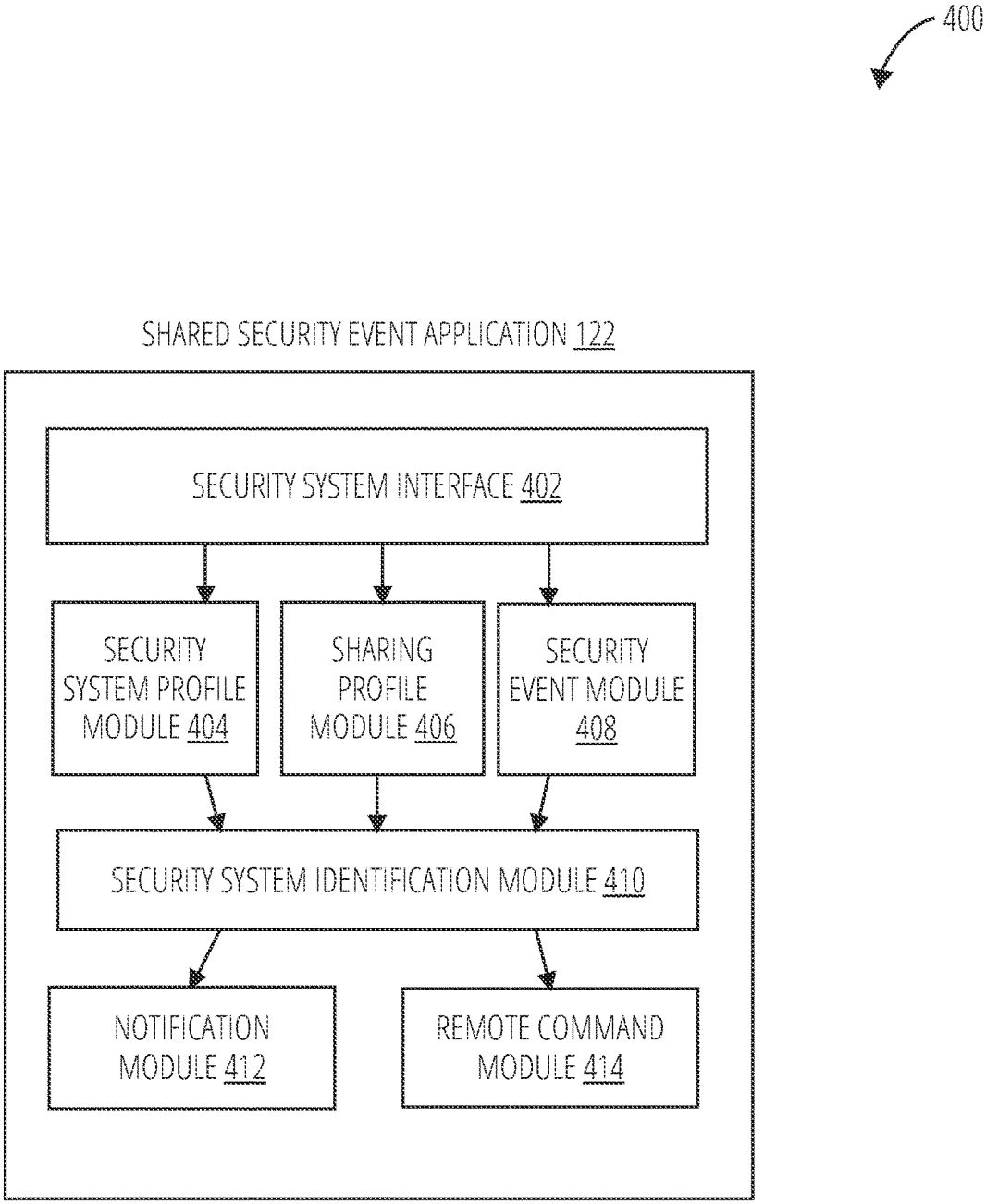
FIG. 4 is a block diagram of a shared security event application, in accordance with one example embodiment.

FIG. 4 is a block diagram 400 of a shared security event application, in accordance with one example embodiment. The shared security event application 122 includes, for example, a security system interface 402, a security system profile module 404, a sharing profile module 406, a security event module 408, a security system identification module 410, a notification module 412, and a remote command module 414. The security system interface 402 communicates with security systems. For example, the security system interface 402 communicates with security systems belonging to a common group (e.g., apartment complex 302), a same company, or a same location (e.g., office campus). Those of ordinary skill in the art will recognize that security systems may be grouped in various ways: by location, by shared privileges, by user-specific requests, by entity, and so forth. The security system interface 402 communicates with a security system and receives alert notifications from the security system. In one example, the security system interface 402 can forward the alert notifications to other security systems. In another example, the security system interface 402 can also provide remote commands to the other security systems.

The security system profile module 404 accesses a security system profile of a security system. For example, the security system profile module 404 queries the security system profile of the security system 130 to access, for example, sensor information, user profile, sharing information, geographic location, and security system status.

Figure 5:
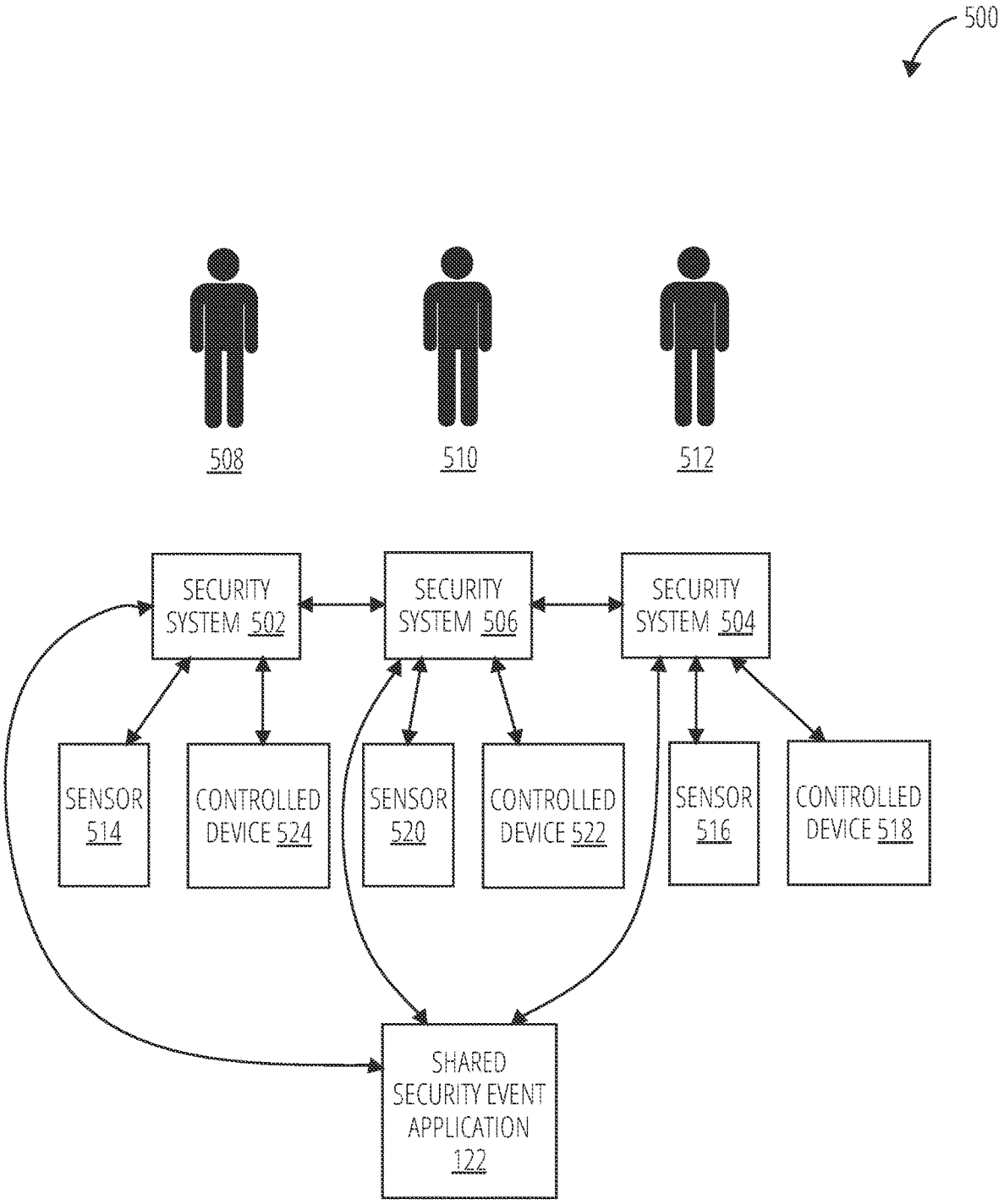
FIG. 5 illustrates an example of a network environment for security systems, in accordance with one example embodiment.

FIG. 5 illustrates an example of a network environment 500 for security systems, in accordance with one example embodiment. Each user may be associated with a security system. For example, user 508 is associated with security system 502. User 510 is associated with security system 506. User 512 is associated with security system 504. Each security system may be coupled to its own sensors (e.g., smoke sensor) and controlled devices (e.g., door lock). For example, security system 502 is coupled to sensor 514 and controlled device 524. Security system 506 is coupled to sensor 520 and controlled device 522. Security system 504 is coupled to sensor 516 and controlled device 518. Each security system is registered with the shared security event application 122.

Figure 6:
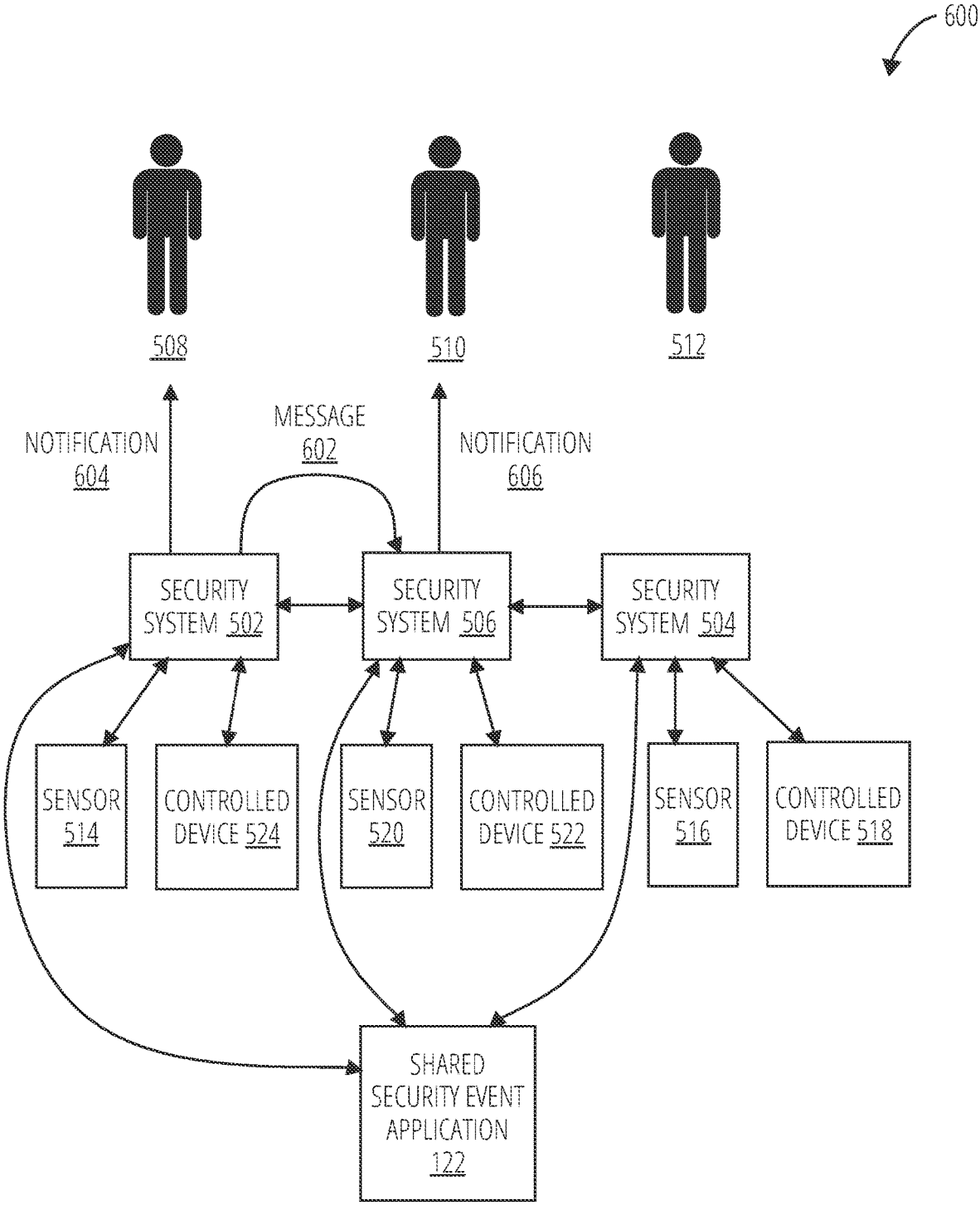
FIG. 6 illustrates another example of a network environment for security systems, in accordance with one example embodiment.

FIG. 6 illustrates another example of a network environment 600 for security systems, in accordance with one example embodiment. In this example, the security system 502 determines that the sensor 514 detects an event (e.g., glass break). The security system 502 generates a notification 604 to the user 508 (e.g., by sending an alert to a mobile device of the user 508). The security system 502 also sends a notification of the event to the shared security event application 122. The shared security event application 122 identifies the security system 506 based on the alert and generates an alert or forwards the alert to the security system 506. In another example embodiment, the security system 502 identifies the security system 506 as a trusted security system based on the alert and the sharing notification profile (provided by the shared security event application 122). The security system 502 sends a message 602 to the security system 506. The security system 506 generates a notification 606 to the user 510. In the present example, the user 512/security system 504 is not included in the sharing notification profile of the user 508/security system 502. Therefore, the security system 502 does not notify the user 512/security system 504 of the alert.

Figure 7:
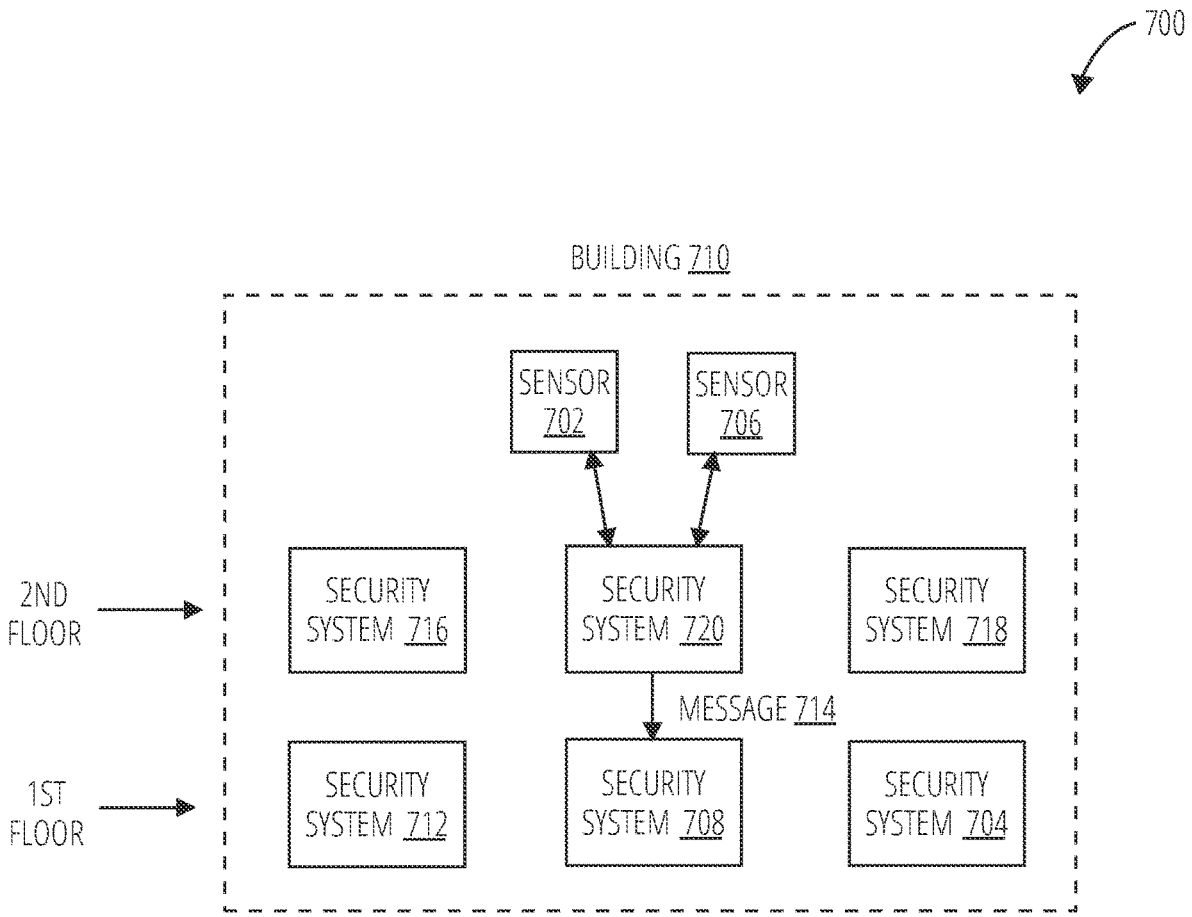
FIG. 7 is a block diagram illustrating an example operation of a notification from a security system, in accordance with one example embodiment.

FIG. 7 is a block diagram 700 illustrating an example operation of a notification from a security system, in accordance with one example embodiment. FIG. 7 illustrates a building 710 with different units in their respective location. Each unit has its own security system (e.g., security system 716, security system 720, security system 718, security system 712, security system 708, security system 704). FIG. 7 illustrates that the security system 716, security system 720, and security system 718 are located on the same floor (e.g., 2nd floor). Security system 712, security system 708, and security system 704 are located on the 1st floor and under security system 716, security system 720, and security system 718, respectively.

Security system 720 is coupled to sensor 702 (e.g., water sensor) and sensor 706 (e.g., smoke sensor). The security system 720 determines that the sensor 702 has detected water. The security system 720 identifies the security system 708 based on the alert (e.g., water leak), the type of sensor (e.g., water sensor), and the topography of the security system 720/building 710. The topography includes information about the respective locations of the security systems/apartment units relative to each other: apartment with security system 708 is located right under apartment with security system 720. Once the security system 720 has identified the security system 708, the security system 720 communicates a message 714 to the security system 708. The message 714 includes a notification that the sensor 702 has detected a water leak. In another example, the security system 708 may be notified by the shared security event application 122.

Figure 8:
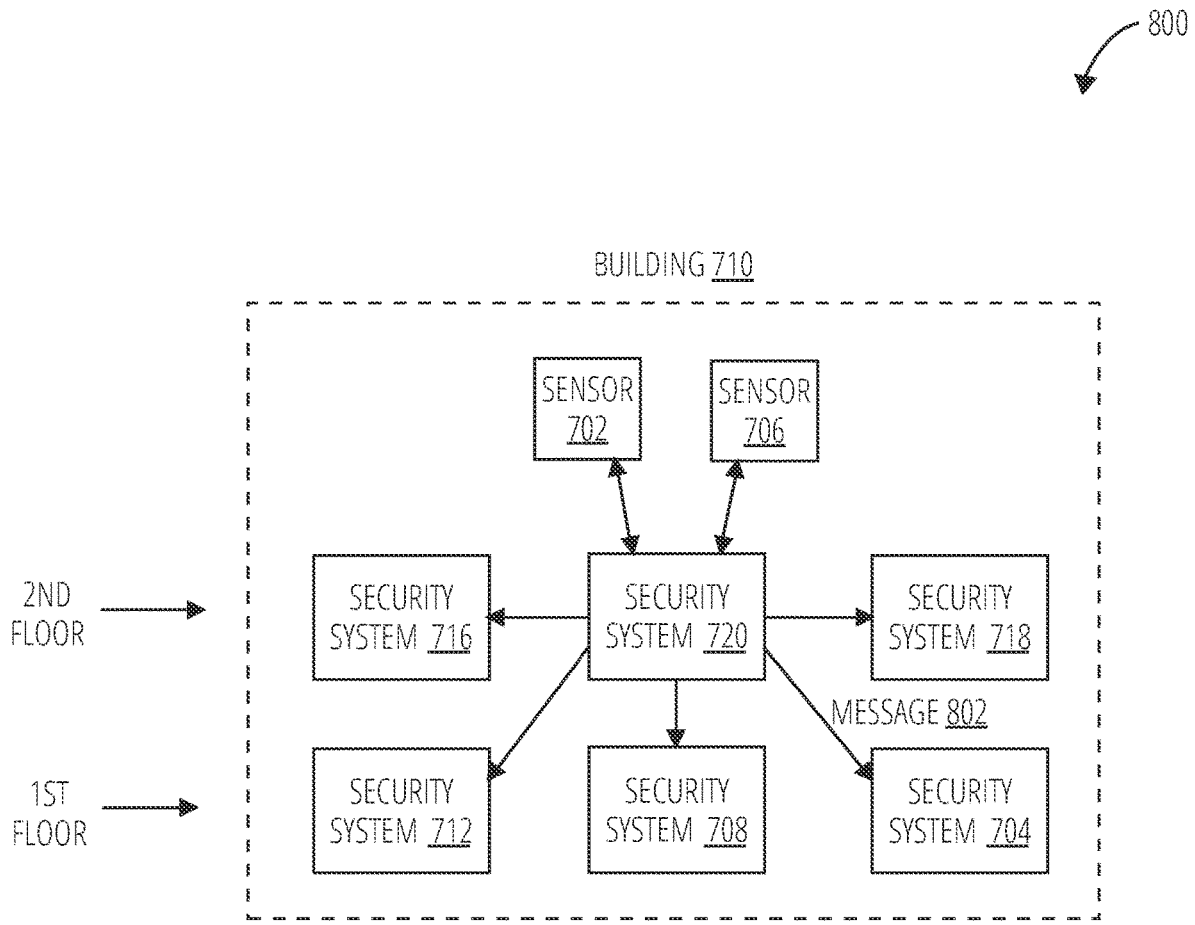
FIG. 8 is a block diagram illustrating another example operation of a notification from a security system, in accordance with one example embodiment.

FIG. 8 is a block diagram 800 illustrating another example operation of a notification from a security system, in accordance with one example embodiment. The security system 720 determines that the sensor 706 has detected smoke. The security system 720 identifies all nearby security systems in the building 710 based on the alert (e.g., smoke), the type of sensor (e.g., smoke detector), and the topography of the security system 720/building 710. In this example, because fire can spread throughout the building 710, the preset sharing profile may specify notifying all neighbors in the building 710 for a detected fire. In another example, the preset sharing profile may be modified to notify only adjacent neighbors on the same floor or other neighbors within user-preset boundaries. Thus, the security system 720 communicates a message 802 (e.g., fire alert) to security system 716, security system 712, security system 708, security system 704, and security system 718. The message 802 includes a notification that the sensor 706 has detected smoke.

Figure 9:
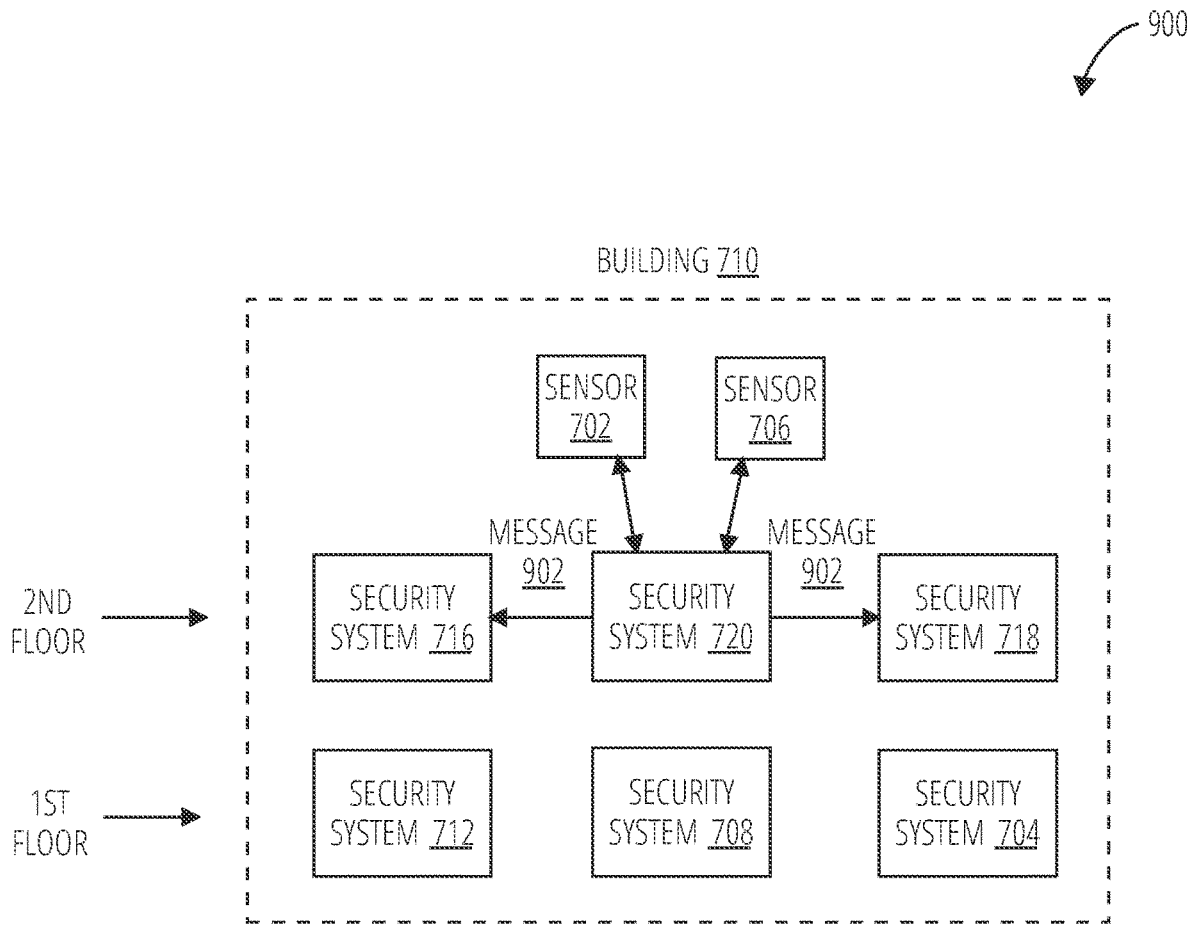
FIG. 9 is a block diagram illustrating another example operation of a notification from a security system, in accordance with one example embodiment.

FIG. 9 is a block diagram 900 illustrating another example operation of a notification from a security system, in accordance with one example embodiment. The security system 720 determines that the sensor 706 (e.g., a glass break sensor) has detected a glass breakage. The security system 720 identifies nearby security systems in the building 710 based on the alert (e.g., intruder), the type of sensor (e.g., glass break), and the topography of the security system 720/building 710. In this example, neighbors that are adjacent to the unit with security system 720 and located on the same floor as security system 720 can be notified of the intrusion and can quickly react and check on the unit with the security system 720. Thus, the security system 720 communicates a message 902 (e.g., burglar alert) to security system 716 and security system 718 that are located on the same floor. The message 902 includes a notification that the sensor 706 has detected glass breakage.

Figure 10:
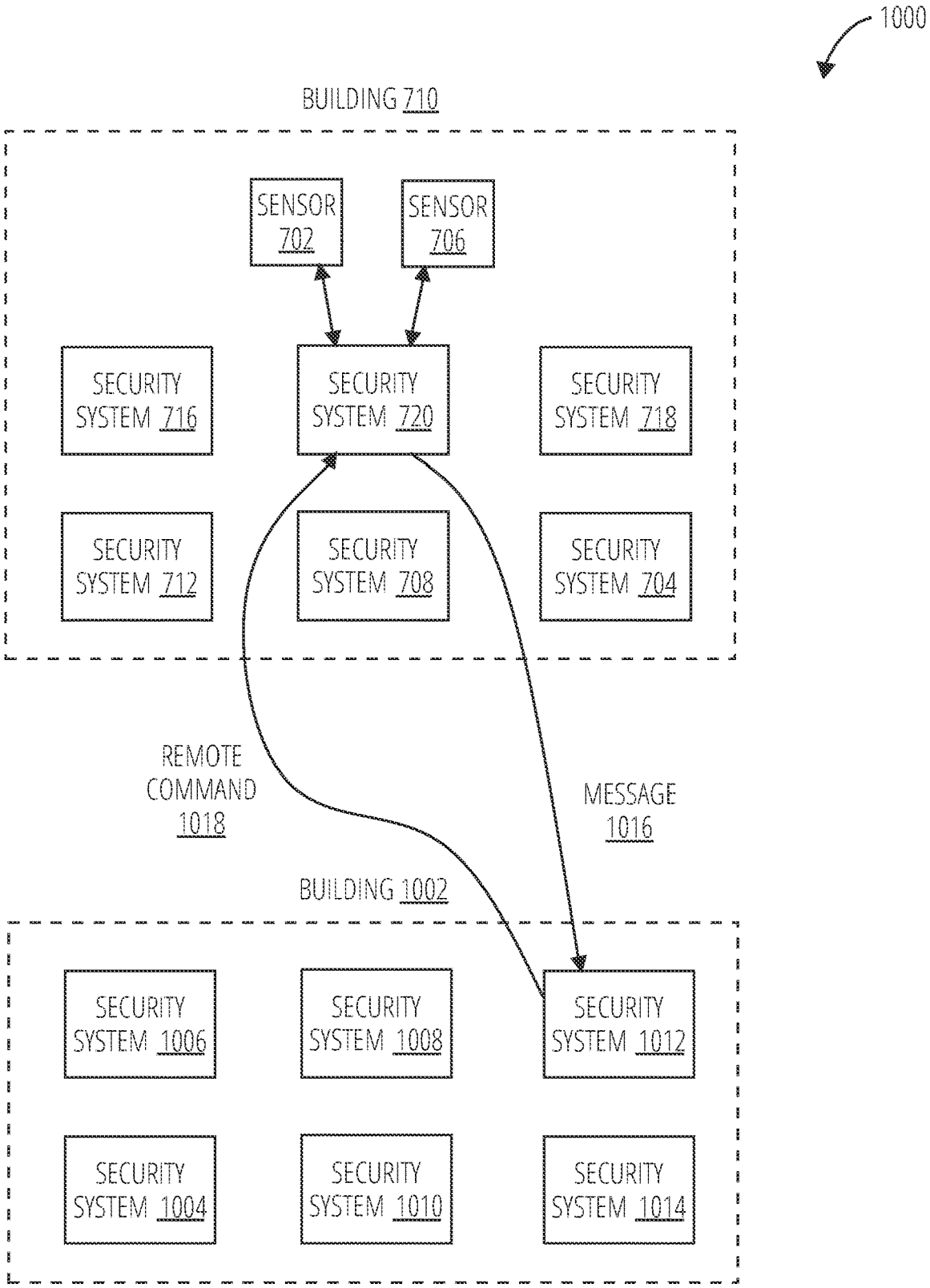
FIG. 10 is a block diagram illustrating another example operation of a notification from a security system, in accordance with one example embodiment.

FIG. 10 is a block diagram 1000 illustrating another example operation of a notification from a security system, in accordance with one example embodiment. The security system 720 determines that the sensor 706 (e.g., a motion sensor) has detected a motion. The security system 720 identifies security systems based on the alert (e.g., motion alert), the type of sensor (e.g., motion sensor), and the user-defined sharing profile of the security system 720. In this example, the user of the security system 720 has specified that when the security system 720 detects an unexpected motion, the security system 720 is to also notify the security system 1012 located in another building 1002. Thus, the security system 720 communicates a message 1016 (e.g., motion alert) to security system 1012 that is located in another building 1002. The building 1002 includes security system 1006, security system 1008, security system 1012, security system 1004, security system 1010, and security system 1014. The message 1016 includes a notification that the sensor 706 has motion. The notification is not limited to other security systems in the building 710 but can be to any other security system or mobile devices identified by the user of the security system 720. In another example embodiment, the security system 1012 issues a remote command 1018 to the security system 720 in response to the message 1016. For example, the remote command 1018 may include turning on a light (e.g., lights throughout the apartment unit of the security system 720) controlled by the security system 720, or a voice message ("Go away, I'm calling the police!") from a user of the security system 1012 to be played in a speaker connected to the security system 720.

FIG. 11 is a table 1100 illustrating an example of a sharing profile of a security system, in accordance with one example embodiment. The table 1100 includes a sensor ID 1102, a sensor type 1106, a sensor status 1104, a sensor notification vector 1112, a security system source 1108, and a security system target 1110. The sensor ID 1102 identifies the name of the sensor: for example, WS1, SM1, GL1, EN1. The sensor type 1106 identifies the type of sensor: for example, water sensor, smoke sensor, glass break detector, and door sensor. The sensor status 1104 identifies the status of the sensor: for example, water detected, smoke detected, breaking detected, or open. The sensor notification vector 1112 identifies the direction and range of the notification to the other trusted or shared security systems: for example, one floor below, one floor above and adjacent, adjacent, or user-specified. The security system source 1108 identifies the security system associated with the corresponding sensor that triggered an alert. The security system target 1110 identifies the security systems to be notified based on the sensor ID 1102, sensor type 1106, the sensor status 1104, sensor notification vector 1112, and the security system source 1108. For example, when the water sensor ws1 detects a water leak at the unit of the security system 720, the security system 720 generates a notification to the unit with the security system located one floor below (e.g., security system 708). In another example, when the smoke sensor sm1 detects smoke at the unit of the security system 708, the security system 708 generates a notification to the units with the security system located one floor above and adjacent (e.g., security system 712, 720, 704).

Figure 12:
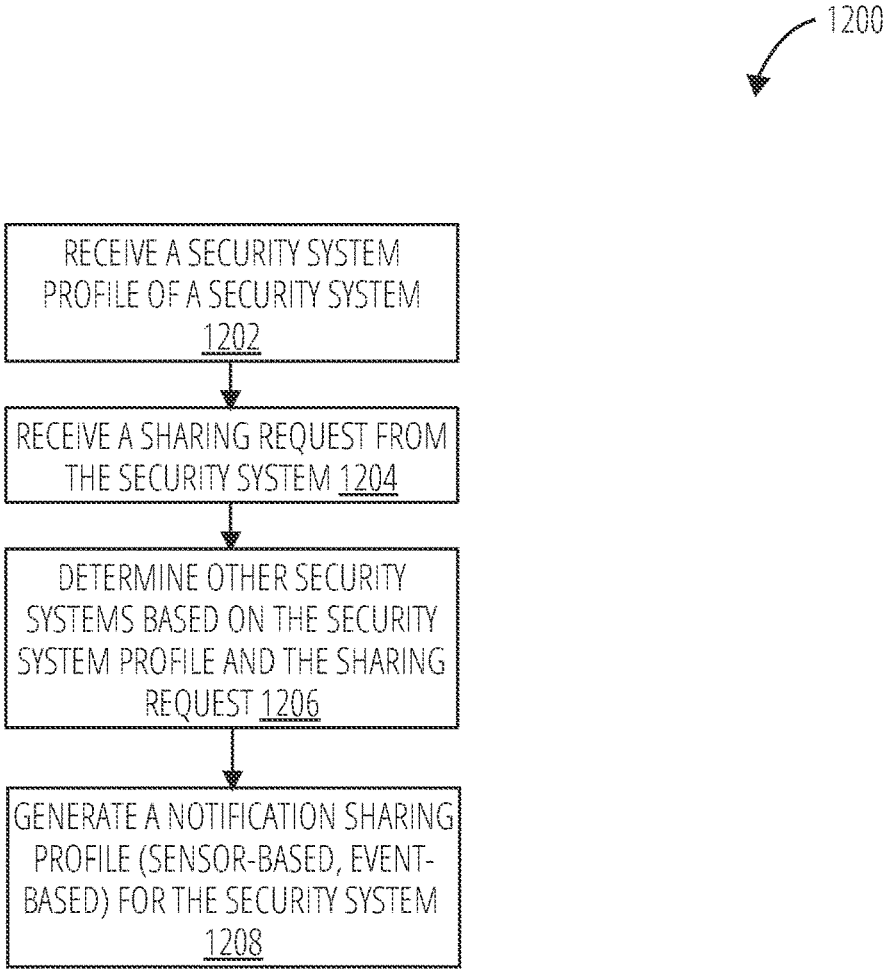
FIG. 12 is a flow diagram illustrating a method for generating a notification sharing profile, in accordance with one example embodiment.

FIG. 12 is a flow diagram 1200 illustrating a method for generating a notification sharing profile, in accordance with one example embodiment. At block 1202, the shared security event application 122 receives a security system profile of a security system. At block 1204, the shared security event application 122 receives a sharing request from the security system (e.g., security system identifies another security system/user to share alert notifications with). At block 1206, the shared security event application 122 determines other security systems based on the security system profile and the sharing request. At block 1208, the shared security event application 122 generates a notification sharing profile for the security system. The notification sharing profile identifies which security systems to alert based on the type of sensor and type of alert.

Figure 13:
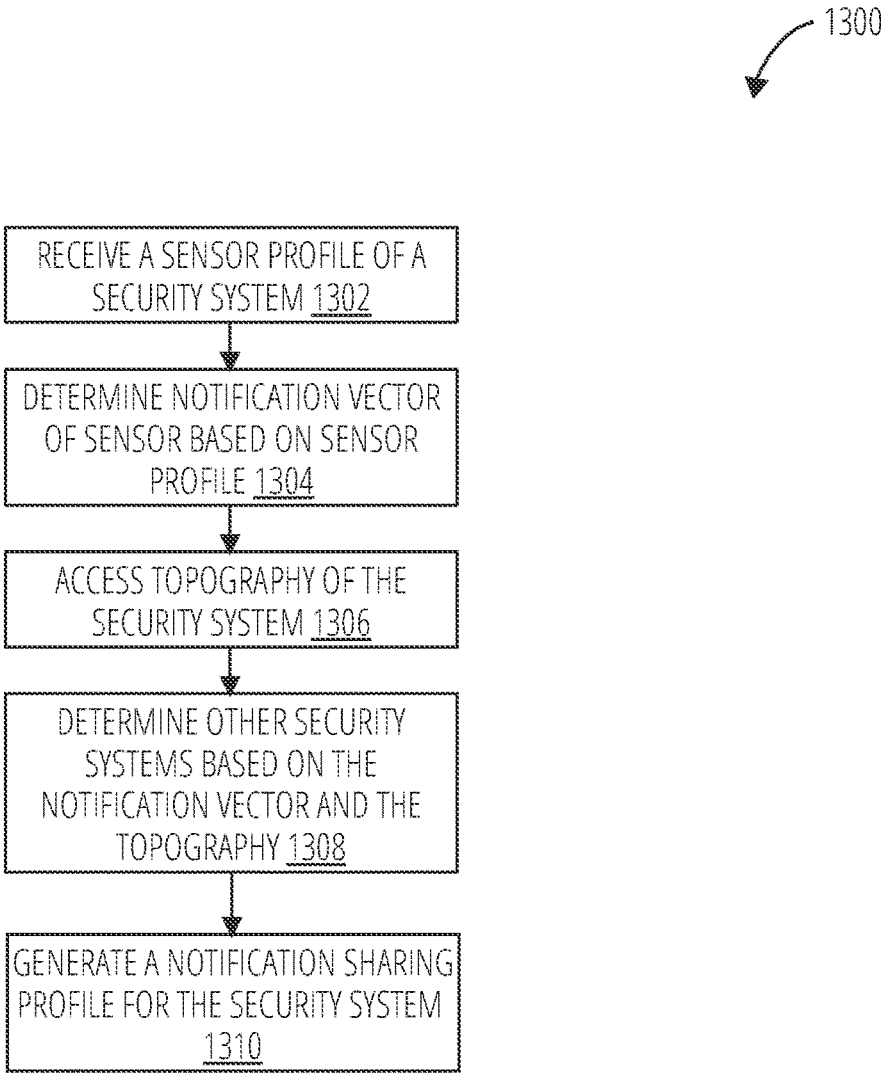
FIG. 13 is a flow diagram illustrating a method for generating a notification sharing profile, in accordance with another example embodiment.

FIG. 13 is a flow diagram 1300 illustrating a method for generating a notification sharing profile, in accordance with another example embodiment. At block 1302, the shared security event application 122 receives a sensor profile (e.g., sensor name, sensor type, sensor status, associated security system) of a security system. At block 1304, the shared security event application 122 determines a notification vector of the sensor based on the sensor profile (e.g., same floor, up to two units away). At block 1306, the shared security event application 122 accesses the topography of the security system or the location associated with the security system. At block 1308, the shared security event application 122 determines other security systems based on the notification vector and the topography. At block 1310, the shared security event application 122 generates a notification sharing profile for the security system.

Figure 14:
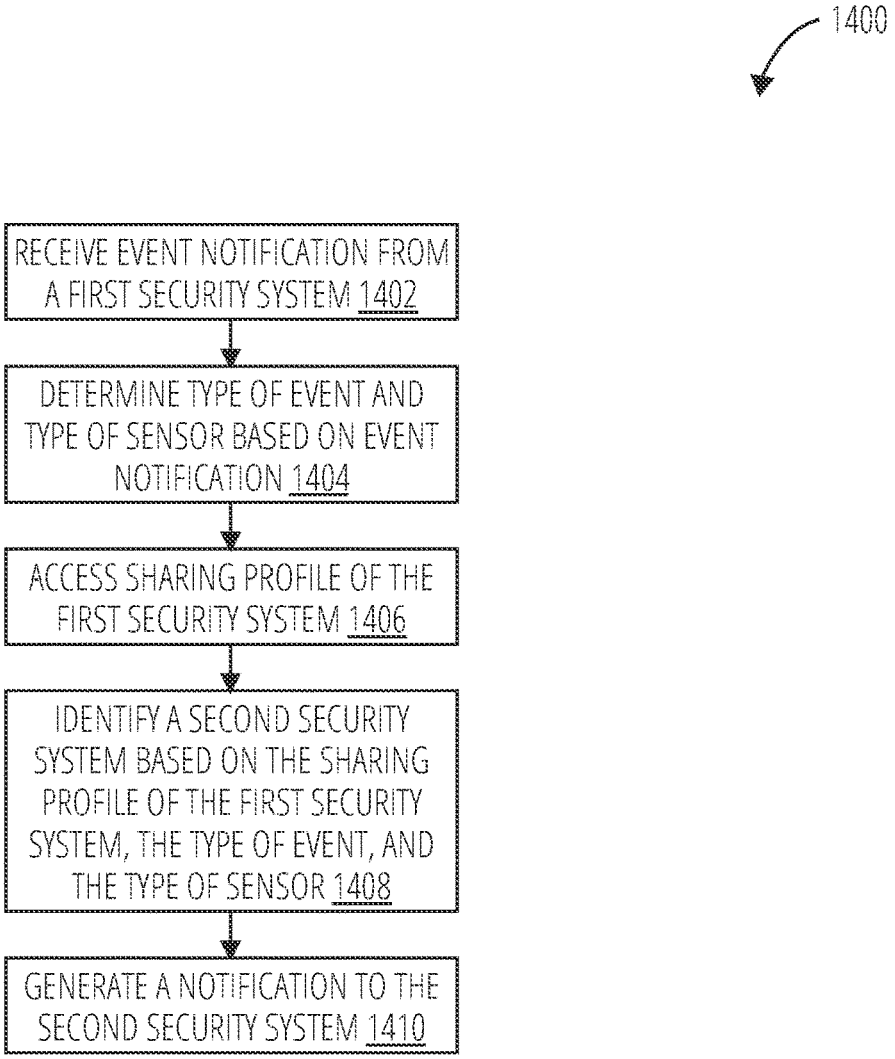
FIG. 14 is a flow diagram illustrating a method for generating a notification, in accordance with one example embodiment.

FIG. 14 is a flow diagram 1400 illustrating a method for generating a notification, in accordance with one example embodiment. At block 1402, the shared security event application 122 receives an event notification from a first security system. At block 1404, the shared security event application 122 determines the type of event and type of sensor based on the event notification. At block 1406, the shared security event application 122 accesses the sharing profile of the first security system. At block 1408, the shared security event application 122 identifies a second security system based on the sharing profile of the first security system, the type of event, and the type of sensor. At block 1410, the shared security event application 122 generates a notification to the second security system.

Figure 15:
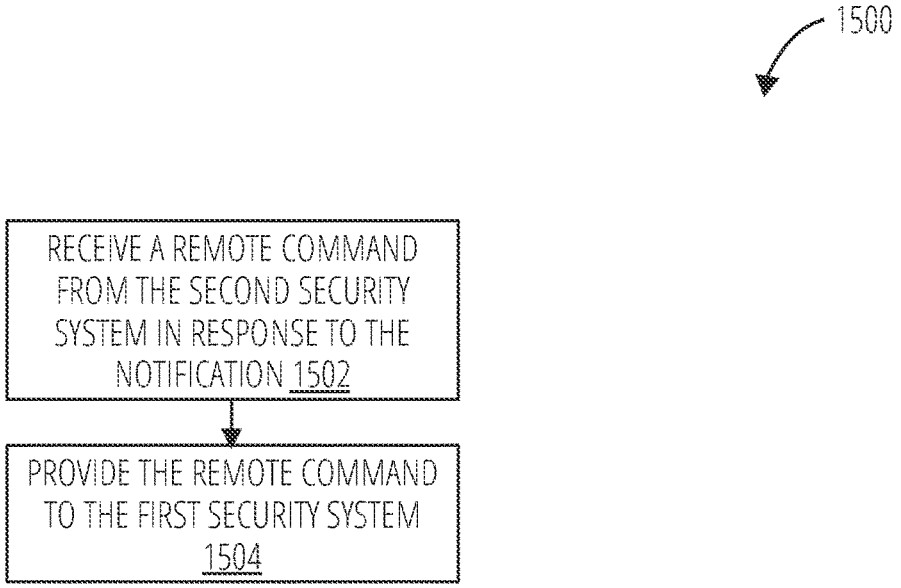
FIG. 15 is a flow diagram illustrating a method for providing a remote command to a security system, in accordance with one example embodiment.

FIG. 15 is a flow diagram 1500 illustrating a method for providing a remote command to a security system, in accordance with one example embodiment. At block 1502, the shared security event application 122 receives a remote command (to control a device connected to the first security system) from the second security system in response to the notification (e.g., remotely close all doors in the unit of the first security system in response to detecting smoke). At block 1504, the shared security event application 122 provides the remote command to the first security system. The first security system is configured to operate the remote command.

Figure 16:
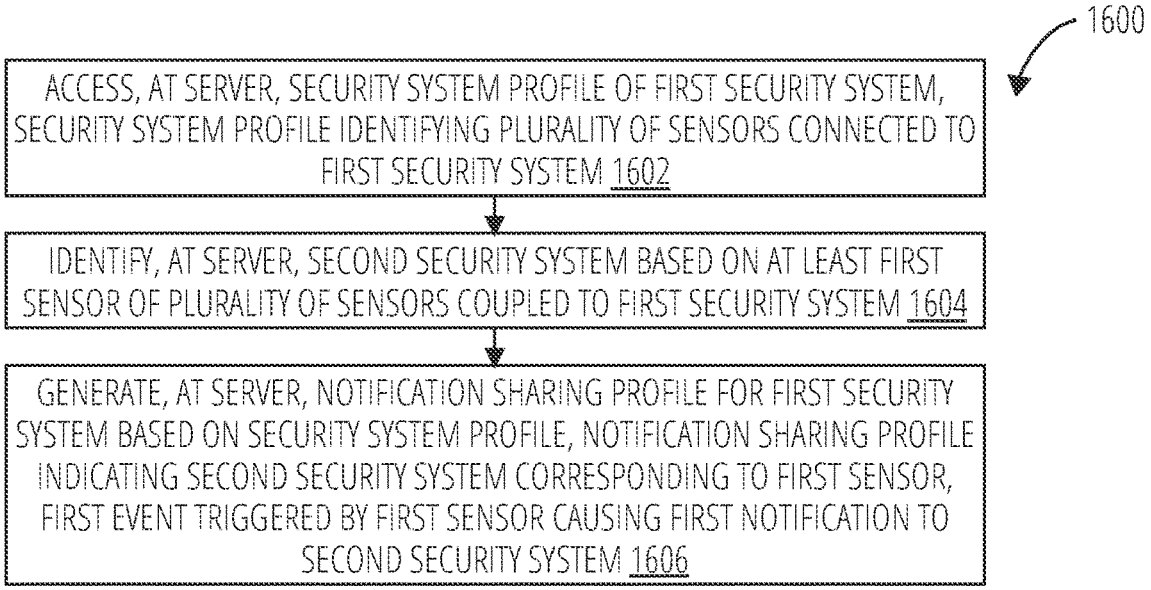
FIG. 16 illustrates a routine, in accordance with one embodiment.

FIG. 16 is a flow diagram illustrating a method for providing a remote command to a security system, in accordance with one example embodiment. In block 1602, routine 1600 accesses, at a server, a security system profile of a first security system, the security system profile identifying a plurality of sensors connected to the first security system. In block 1604, routine 1600 identifies, at the server, a second security system based on at least a first sensor of the plurality of sensors coupled to the first security system. In block 1606, routine 1600 generates, at the server, a notification sharing profile for the first security system based on the security system profile, the notification sharing profile indicating the second security system corresponding to the first sensor, a first event triggered by the first sensor causing a first notification to the second security system. In another example embodiment, a camera from a first security system detects an unusual vehicle or person in a predefined neighborhood or geographic zone. The first security system notifies other security systems in the predefined neighborhood or geographic zone.

Figure 17:
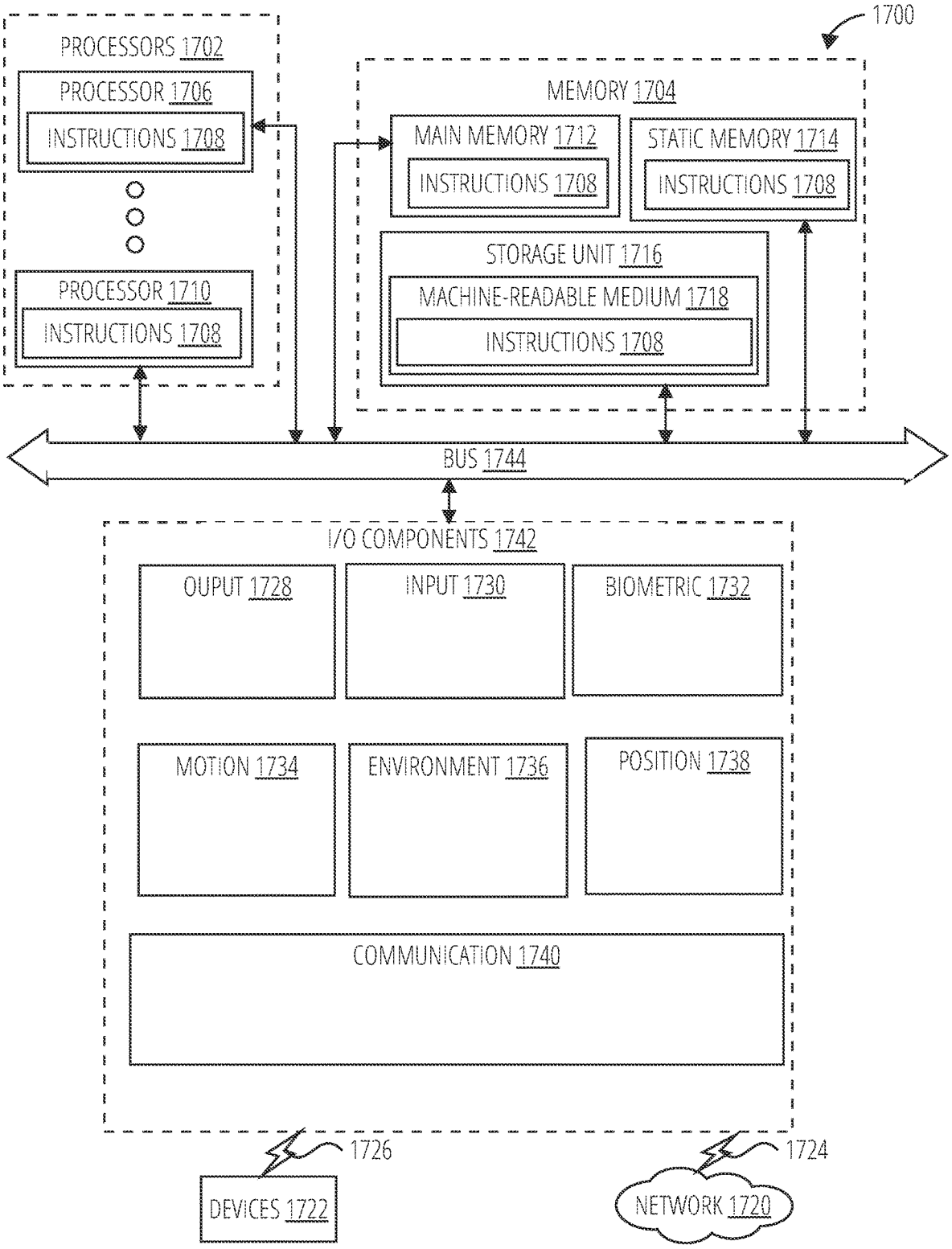
FIG. 17 is a diagrammatic representation of a machine in the form of a computer system within which a set of instructions may be executed for causing the machine to perform any one or more of the methodologies discussed herein, according to an example embodiment.

FIG. 17 is a diagrammatic representation of the machine 1700 within which instructions 1708 (e.g., software, a program, an application, an applet, an app, or other executable code) for causing the machine 1700 to perform any one or more of the methodologies discussed herein may be executed. For example, the instructions 1708 may cause the machine 1700 to execute any one or more of the methods described herein. The instructions 1708 transform the general, non-programmed machine 1700 into a particular machine 1700 programmed to carry out the described and illustrated functions in the manner described. The machine 1700 may operate as a standalone device or may be coupled (e.g., networked) to other machines. In a networked deployment, the machine 1700 may operate in the capacity of a server machine or a client machine in a server-client network environment, or as a peer machine in a peer-to-peer (or distributed) network environment. The machine 1700 may comprise, but not be limited to, a server computer, a client computer, a personal computer (PC), a tablet computer, a laptop computer, a netbook, a set-top box (STB), a PDA, an entertainment media system, a cellular telephone, a smart phone, a mobile device, a wearable device (e.g., a smart watch), a smart home device (e.g., a smart appliance), other smart devices, a web appliance, a network router, a network switch, a network bridge, or any machine capable of executing the instructions 1708, sequentially or otherwise, that specify actions to be taken by the machine 1700. Further, while only a single machine 1700 is illustrated, the term "machine" shall also be taken to include a collection of machines that individually or jointly execute the instructions 1708 to perform any one or more of the methodologies discussed herein.

The machine 1700 may include processors 1702, memory 1704, and I/O components 1742, which may be configured to communicate with each other via a bus 1744. In an example embodiment, the processors 1702 (e.g., a Central Processing Unit (CPU), a Reduced Instruction Set Computing (RISC) processor, a Complex Instruction Set Computing (CISC) processor, a Graphics Processing Unit (GPU), a Digital Signal Processor (DSP), an ASIC, a Radio-Frequency Integrated Circuit (RFIC), another processor, or any suitable combination thereof) may include, for example, a processor 1706 and a processor 1710 that execute the instructions 1708. The term "processor" is intended to include multi-core processors that may comprise two or more independent processors (sometimes referred to as "cores") that may execute instructions contemporaneously. Although FIG. 17 shows multiple processors 1702, the machine 1700 may include a single processor with a single core, a single processor with multiple cores (e.g., a multi-core processor), multiple processors with a single core, multiple processors with multiples cores, or any combination thereof.

The memory 1704 includes a main memory 1712, a static memory 1714, and a storage unit 1716, both accessible to the processors 1702 via the bus 1744. The main memory 1704, the static memory 1714, and storage unit 1716 store the instructions 1708 embodying any one or more of the methodologies or functions described herein. The instructions 1708 may also reside, completely or partially, within the main memory 1712, within the static memory 1714, within machine-readable medium 1718 within the storage unit 1716, within at least one of the processors 1702 (e.g., within the processor's cache memory), or any suitable combination thereof, during execution thereof by the machine 1700.

The I/O components 1742 may include a wide variety of components to receive input, provide output, produce output, transmit information, exchange information, capture measurements, and so on. The specific I/O components 1742 that are included in a particular machine will depend on the type of machine. For example, portable machines such as mobile phones may include a touch input device or other such input mechanisms, while a headless server machine will likely not include such a touch input device. It will be appreciated that the I/O components 1742 may include many other components that are not shown in FIG. 17. In various example embodiments, the I/O components 1742 may include output components 1728 and input components 1730. The output components 1728 may include visual components (e.g., a display such as a plasma display panel (PDP), a light emitting diode (LED) display, a liquid crystal display (LCD), a projector, or a cathode ray tube (CRT)), acoustic components (e.g., speakers), haptic components (e.g., a vibratory motor, resistance mechanisms), other signal generators, and so forth. The input components 1730 may include alphanumeric input components (e.g., a keyboard, a touch screen configured to receive alphanumeric input, a photo-optical keyboard, or other alphanumeric input components), point-based input components (e.g., a mouse, a touchpad, a trackball, a joystick, a motion sensor, or another pointing instrument), tactile input components (e.g., a physical button, a touch screen that provides location and/or force of touches or touch gestures, or other tactile input components), audio input components (e.g., a microphone), and the like.

In further example embodiments, the I/O components 1742 may include biometric components 1732, motion components 1734, environmental components 1736, or position components 1738, among a wide array of other components. For example, the biometric components 1732 include components to detect expressions (e.g., hand expressions, facial expressions, vocal expressions, body gestures, or eye tracking), measure biosignals (e.g., blood pressure, heart rate, body temperature, perspiration, or brain waves), identify a person (e.g., voice identification, retinal identification, facial identification, fingerprint identification, or electroencephalogram-based identification), and the like. The motion components 1734 include acceleration sensor components (e.g., accelerometer), gravitation sensor components, rotation sensor components (e.g., gyroscope), and so forth. The environmental components 1736 include, for example, illumination sensor components (e.g., photometer), temperature sensor components (e.g., one or more thermometers that detect ambient temperature), humidity sensor components, pressure sensor components (e.g., barometer), acoustic sensor components (e.g., one or more microphones that detect background noise), proximity sensor components (e.g., infrared sensors that detect nearby objects), gas sensors (e.g., gas detection sensors to detection concentrations of hazardous gases for safety or to measure pollutants in the atmosphere), or other components that may provide indications, measurements, or signals corresponding to a surrounding physical environment. The position components 1738 include location sensor components (e.g., a GPS receiver component), altitude sensor components (e.g., altimeters or barometers that detect air pressure from which altitude may be derived), orientation sensor components (e.g., magnetometers), and the like.

Communication may be implemented using a wide variety of technologies. The I/O components 1742 further include communication components 1740 operable to couple the machine 1700 to a network 1720 or devices 1722 via a coupling 1724 and a coupling 1726, respectively. For example, the communication components 1740 may include a network interface component or another suitable device to interface with the network 1720. In further examples, the communication components 1740 may include wired communication components, wireless communication components, cellular communication components, Near Field Communication (NFC) components, Bluetooth® components (e.g., Bluetooth® Low Energy), WiFi® components, and other communication components to provide communication via other modalities. The devices 1722 may be another machine or any of a wide variety of peripheral devices (e.g., a peripheral device coupled via a USB).

Moreover, the communication components 1740 may detect identifiers or include components operable to detect identifiers. For example, the communication components 1740 may include Radio Frequency Identification (RFID) tag reader components, NFC smart tag detection components, optical reader components (e.g., an optical sensor to detect one-dimensional bar codes such as Universal Product Code (UPC) bar code, multi-dimensional bar codes such as Quick Response (QR) code, Aztec code, Data Matrix, Dataglyph, MaxiCode, PDF417, Ultra Code, UCC RSS-2D bar code, and other optical codes), or acoustic detection components (e.g., microphones to identify tagged audio signals). In addition, a variety of information may be derived via the communication components 1740, such as location via Internet Protocol (IP) geolocation, location via Wi-Fi® signal triangulation, location via detecting an NFC beacon signal that may indicate a particular location, and so forth.

The various memories (e.g., memory 1704, main memory 1712, static memory 1714, and/or memory of the processors 1702) and/or storage unit 1716 may store one or more sets of instructions and data structures (e.g., software) embodying or used by any one or more of the methodologies or functions described herein. These instructions (e.g., the instructions 1708), when executed by processors 1702, cause various operations to implement the disclosed embodiments.

The instructions 1708 may be transmitted or received over the network 1720, using a transmission medium, via a network interface device (e.g., a network interface component included in the communication components 1740) and using any one of a number of well-known transfer protocols (e.g., hypertext transfer protocol (HTTP)). Similarly, the instructions 1708 may be transmitted or received using a transmission medium via the coupling 1726 (e.g., a peer-to-peer coupling) to the devices 1722.

Although an embodiment has been described with reference to specific example embodiments, it will be evident that various modifications and changes may be made to these embodiments without departing from the broader scope of the present disclosure. Accordingly, the specification and drawings are to be regarded in an illustrative rather than a restrictive sense. The accompanying drawings that form a part hereof, show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

what is claimed is:

1. A method comprising:

detecting, at a server, an event generated by a first sensor that is externally coupled to a first security system;

in response to detecting the event, identifying a second security system that is mapped to the first sensor; and generating, at the server, a message indicating the event wherein the first sensor is a water sensor, wherein the event indicates a water leak, wherein the first security system and the first sensor are located in a first geographical location, wherein the second security system is located in a second geographical location that is below the first geographical location.

2. The method of claim 1, further comprising:

mapping the first sensor to the second security system.

3. The method of claim 1, further comprising:

mapping an identification and a type of the first sensor to the second security system.

4. The method of claim 1, further comprising:

communicating the message to the second security system, the second security system configured to generate an alert based on the message.

5. The method of claim 1, further comprising:

communicating the message to a device registered with the second security system.

6. The method of claim 1, further comprising:

receiving, at the server, a remote command from the second security system in response to communicating the message to the second security system; and providing the remote command to the first security system.

7. The method of claim 1, further comprising:

accessing, at the server, a notification sharing profile of the first security system, the notification sharing profile comprising a mapping of the event, an identification of the first sensor, a type of the first sensor, and the second security system.

8. The method of claim 1, further comprising:

accessing, at the server, a notification sharing profile of the first security system, the notification sharing profile comprising a mapping of the event, an identification of a second sensor externally connected to the first security system, a type of the second sensor, and the second security system.

9. A server comprising:

a processor; and a memory storing instructions that, when executed by the processor, configure the server to perform operations comprising:

detecting an event generated by a first sensor that is externally coupled to a first security system;

in response to detecting the event, identifying a second security system that is mapped to the first sensor; and generating a message indicating the event, wherein the first sensor is a water sensor, wherein the event indicates a water leak, wherein the first security system and the first sensor are located in a first geographical location, wherein the second security system is located in a second geographical location that is below the first geographical location.

10. The server of claim 9, wherein the operations further comprise:

mapping the first sensor to the second security system.

11. The server of claim 9, wherein the operations further comprise:

mapping an identification and a type of the first sensor to the second security system.

12. The server of claim 9, wherein the operations further comprise:

communicating the message to the second security system, the second security system configured to generate an alert based on the message.

13. The server of claim 9, wherein the operations further comprise:

communicating the message to a device registered with the second security system.

14. The server of claim 9, wherein the operations further comprise:

receiving a remote command from the second security system in response to communicating the message to the second security system; and providing the remote command to the first security system.

15. The server of claim 9, wherein the operations further comprise:

accessing a notification sharing profile of the first security system, the notification sharing profile comprising a mapping of the event, an identification of the first sensor, a type of the first sensor, and the second security system.

16. The server of claim 9, wherein the operations further comprise:

accessing a notification sharing profile of the first security system, the notification sharing profile comprising a mapping of the event, an identification of a second sensor that is externally connected to the first security system, a type of the second sensor, and the second security system.

17. A non-transitory computer-readable storage medium, the computer- readable storage medium including instructions that, when executed by a computer, cause the computer to perform operations comprising:

detecting, at a server, an event generated by a first sensor that is externally coupled to a first security system;

in response to detecting the event, identifying a second security system that is mapped to the first sensor; and generating, at the server, a message indicating the event wherein the first sensor is a water sensor, wherein the event indicates a water leak, wherein the first security system and the first sensor are located in a first geographical location, wherein the second security system is located in a second geographical location that is below the first geographical location.

* * * * *